US006299036B1

(12) United States Patent
Fuchs

(10) Patent No.: US 6,299,036 B1
(45) Date of Patent: Oct. 9, 2001

(54) EASY TO USE DISPENSING CLOSURE

(75) Inventor: Timothy J. Fuchs, Perrysburg, OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/777,810

(22) Filed: Feb. 6, 2001

(51) Int. Cl.[7] ..... B22D 41/14; B67D 3/00
(52) U.S. Cl. ..... 222/509; 222/559
(58) Field of Search ..... 222/505, 509, 222/518, 559

(56) References Cited

U.S. PATENT DOCUMENTS

| | | | | |
|---|---|---|---|---|
| 1,356,837 | * | 10/1920 | Stegmaier | 222/559 X |
| 2,263,731 | | 11/1941 | Hynek . | |
| 2,652,177 | | 9/1953 | Lagemann . | |
| 2,751,130 | * | 6/1956 | Murphy | 222/509 |
| 2,931,543 | * | 4/1960 | Thomas | 222/559 X |
| 3,174,661 | | 3/1965 | Speicher . | |
| 3,521,796 | | 7/1970 | Roy . | |
| 3,734,125 | * | 5/1973 | Bruce et al. | 222/509 X |
| 4,844,301 | * | 7/1989 | Juillet | 222/509 |
| 5,096,098 | * | 3/1992 | Garcia | 222/518 X |
| 5,261,567 | | 11/1993 | Krall . | |
| 5,358,154 | | 10/1994 | Halm . | |
| 5,890,633 | | 4/1999 | Skillin et al. . | |
| 5,950,881 | * | 9/1999 | Scherman et al. | 222/559 X |

* cited by examiner

*Primary Examiner*—Kenneth Bomberg

(57) ABSTRACT

A two-piece, self-cleansing dispensing closure operable with one hand is disclosed attachable to containers with liquid product. The dispensing closure is an assembly of a closure top and a closure base which are slidably interconnected so that the closure top is laterally movable to open and close the dispensing closure to dispense product from the side of the closure through a dispensing opening. The closure base comprises a hollow tubular enclosure which defines a dispensing channel adapted to receive a plug member on the closure top and an attachment means on the closure base and closure top which allows the slidable interconnection of said pieces. To dispense product from a container attached to the dispensing closure, the closure top is moved laterally away from the dispensing opening so that the plug member slides within the dispensing channel to a position where the dispensing opening is uncovered and product can flow from the container to the dispensing channel and out of the dispensing opening.

16 Claims, 4 Drawing Sheets

EASY TO USE DISPENSING CLOSURE

FIELD OF INVENTION

The present invention relates to a two-piece, self-cleaning dispensing closure that is secured to containers and operable using one hand for dispensing fluids and the like. More particularly, this invention relates to a closure comprising a closure base and closure top which are slidably interconnected so that the closure top is laterally movable to open and close the closure to dispense product from the side of the closure through a dispensing opening.

BACKGROUND OF THE INVENTION

Numerous types of closures and seals adapted to be attached to containers for dispensing product from containers are known in the prior art. Such closures must be capable of being sealed to avoid leakage during shipment, capable of being operated between an opened and closed position without accumulation of excess product on exposed surfaces. U.S. Pat. No. 5,358,154 discloses a one-hand-operable container closure having a sealing apparatus with a sealing cone and pour spout to dispense contents of a container. The sealing cone is brought into and out of sealing engagement with the pour spout in response to an exterior force by means of a flexible wall area. Disadvantages of this closure is the necessity of an expensive and intricate production tooling in order to manufacture the closure with flexible and rigid parts. Another disadvantage of this closure is a tendency of the spout to retain product after dispensing thereby clogging the closure during subsequent use.

It is an object of the present invention to provide a two-piece easy to manufacture dispensing closure for fluids and the like with a self-cleaning orifice to prevent clogging of the closure between uses.

SUMMARY OF THE INVENTION

According to the present invention, there is provided a closure base and a closure top which are slidably interconnected so that the closure top is laterally movable using one hand to open and close the closure to dispense product from the side of the closure through a dispensing opening.

More particularly, the invention comprises a closure base with a top wall and a peripheral skirt extending from the top wall having a means, typically threads, on the internal surface of the peripheral wall, for securing the closure to a finish of a container having product. The top wall of the closure base has an orifice which is in communication with fluid in the container through an opening in the finish of the container. Mounted above the orifice in the top wall of the closure base is a hollow tubular enclosure defining a dispensing channel provided with three openings, a first opening at one end of the enclosure for dispensing fluid from the container, a second opening at the opposite end of the enclosure adapted to receive a plug member which fits within the enclosure for opening and closing the first opening and a third opening, perpendicular to the first and the second opening, in communication with the orifice on the closure base for receiving fluid from the container.

The dispensing closure of the present invention further comprises a closure top having, a top wall, a peripheral skirt and mounted below the top wall a plug member which is adapted to be inserted into the hollow tubular enclosure of the closure base. Once the plug member is inserted into the enclosure the plug member is laterally slidable to open and close the first opening of the enclosure. The closure top and closure bottom are equipped with an attachment means which allows the closure top to slidably interconnect with the closure base.

In order to dispense fluid from the container, the closure top may be slid. using a finger, laterally so that the plug member is moved away from the first opening allowing the liquid to flow from the orifice on the closure base to the third opening of the hollow tubular enclosure and thereafter to the first opening. The closure may be sealed for storage for subsequent use by sliding the closure top toward the first opening so that the plug member is moved toward this first opening to seal the opening and extract any fluid which may be left in the enclosure.

The above-mentioned features and objects of the invention and the manner of attaining them will become more apparent and the invention itself will be understood by reference to the following description of an embodiment of the invention when considered in conjunction with the accompanying drawings.

DETAILED DESCRIPTION OF THE PREFERRED EMBODIMENT

Figure 1:
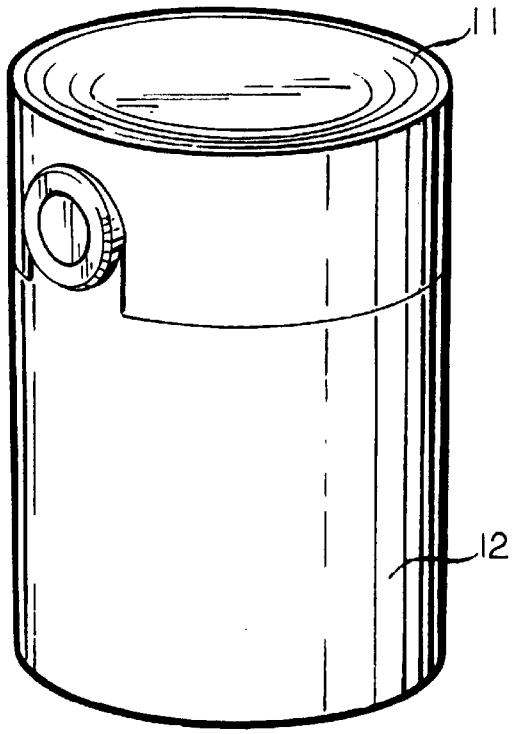
FIG. 1 is a perspective view of an assembled easy to use dispensing closure in a closed position constructed in accordance with the principles of the instant invention.

FIG. 1 shows an assembled two-piece easy to use dispensing closure 10 in a closed position embodying the principles of the instant invention, such dispensing closure operable by lateral movement of a closure top 11. The dispensing closure 10 consists of two components, namely, a closure top 11 and a closure base 12.

Figure 2:
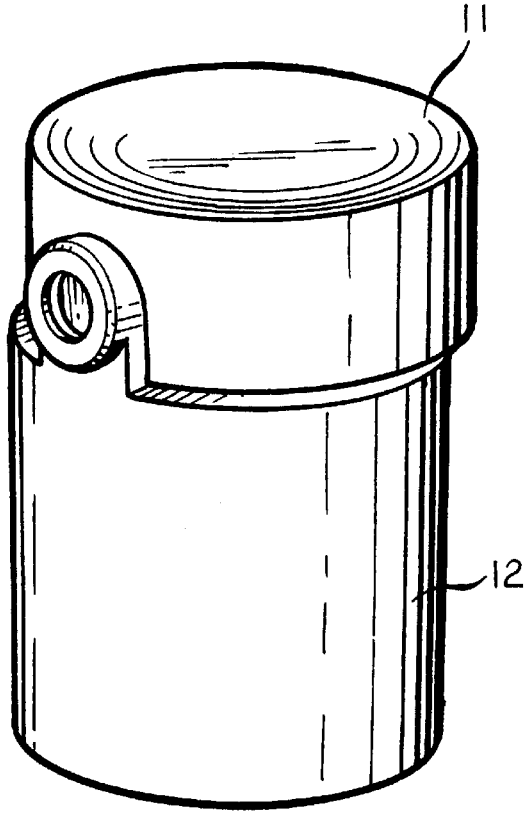
FIG. 2 is a perspective view of an assembled easy to use dispensing closure in an open dispensing position.

FIG. 2 shows the assembled two-piece easy to use dispensing closure 10 in an open dispensing position where the closure top 11 is laterally slid in a position away from the front of the closure base 12.

Figure 3:
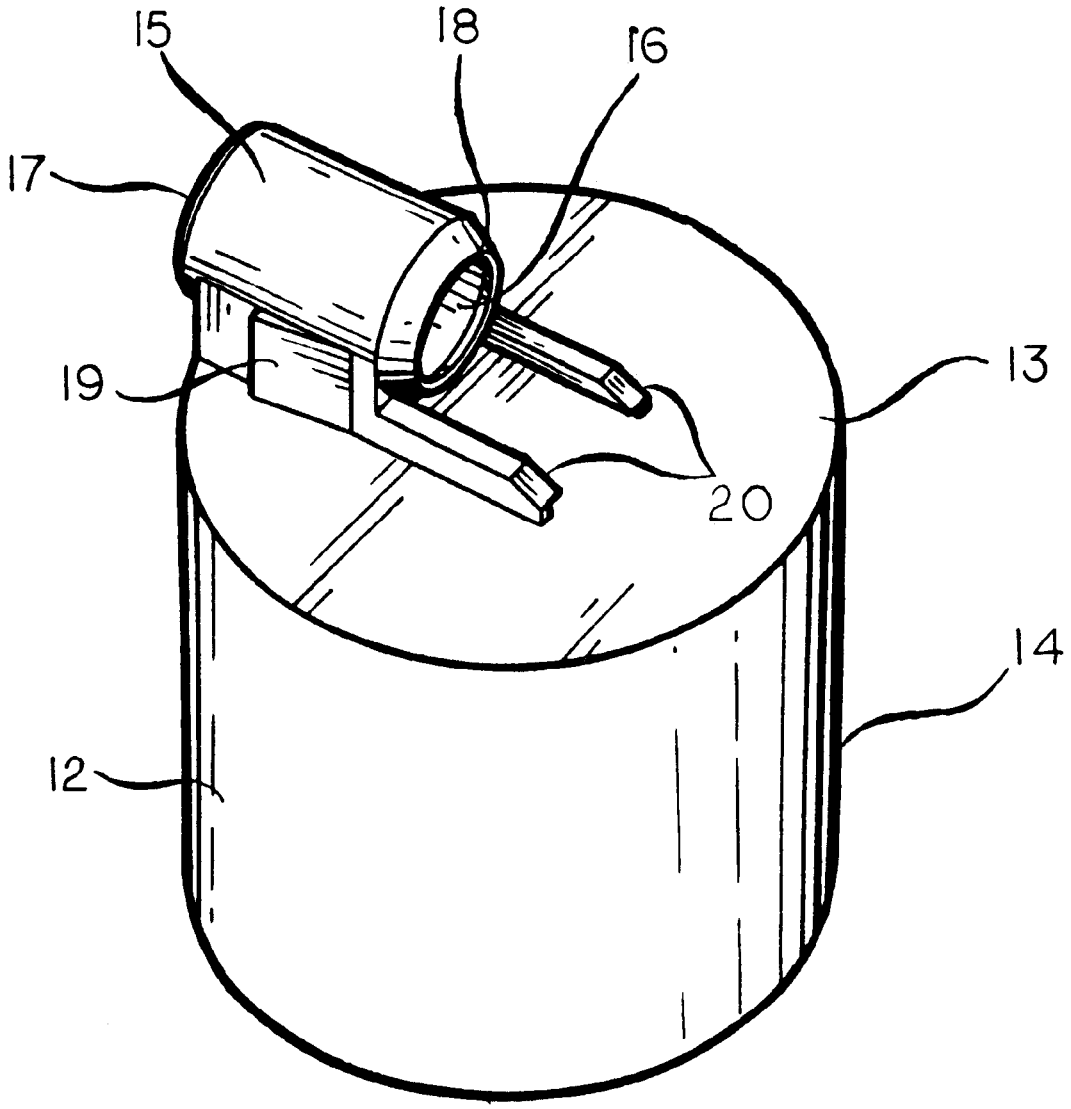
FIG. 3 is an exploded view of the closure base of the easy to use dispensing closure.

FIG. 3 shows the closure base 12 comprising a top wall 13 and peripheral skirt 14 which extends below the top wall with sufficient length for attaching the closure base to a finish of a container. Threads (not shown in FIG. 3) (32 in FIG. 7) on the inner surface of the peripheral skirt 14 of the closure base 12 are utilized for securing the closure base to a container finish of a liquid container. In the top wall 13 of the closure base 12 is an orifice (not shown in FIG. 3) (30 in FIG. 7) which allows fluid communication with the product in the fastened liquid container.

As shown in FIG. 3, mounted above the orifice on the top wall 13 of the closure base 12 is a hollow tubular enclosure 15. The hollow tubular enclosure 15 extends from the center to the outer edge of the top wall 13 and defines a dispensing channel 16 with three openings. The first opening 17 of the dispensing channel 16 located toward the outer edge of the top wall 13 is for dispensing fluid from the liquid container (not shown). The second opening 18 of the dispensing channel 16 located toward the center of the top wall 13 and opposite the first opening 17 is sufficient to receive a plug member 21 which fits within the dispensing channel 16. The dispensing channel 16 is cylindrically-shaped and symmetrical between the first opening 17 and the second opening 18. The third opening 31 (not shown in FIG. 3) is placed perpendicular to the first opening 17 and second opening 18, and is in fluid communication with the orifice 30 in the top wall 13 of the closure base 12.

As also shown in FIG. 3 mounted below the hollow tubular enclosure 15 which defines the dispensing channel 16 are stops (one depicted at 19) on each side of the enclosure 15 spaced a sufficient distance from the outer edge of the closure base 12 to allow the closure top 11 to be moved laterally for opening and closing the dispensing closure 10. Rails 20 are mounted below the second opening 18 of the dispensing channel 16 and are the shape of an inverted "L" to receive the corresponding attachment means 25 of closure top 11. The length of the rails 20 is sufficient to allow slidable interconnection between the closure top 11 and closure base 12 so that the closure top 11 may be moved laterally in relation with the closure base 12 to open and close the dispensing closure 10.

Figure 4:
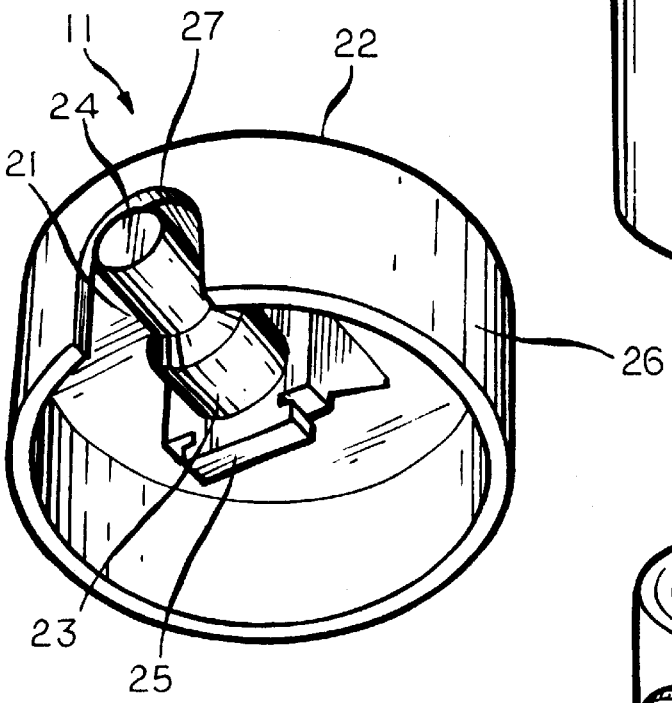
FIG. 4 is an exploded view of the closure top of the easy to use dispensing closure.

FIG. 4 shows the plug member 21 mounted below the top wall 22 of the closure top 11. The plug member 21 is the shape of a solid cylindrical shaft which extends from the center to the outer edge of the closure top 11. Plug member 21 comprises a greater diameter member 23 toward the center of the closure top 11 and gradually tapers to a lesser diameter member 24 toward the outer edge of the closure top 11. Also mounted under the center of the closure top wall 22 below the plug member 21 is an attachment means 25 comprising an inverted T-shaped notch which slidably interconnects with the rails 20 on the closure base 12. The closure top 11 further comprises a peripheral skirt 26 that extends below the top wall 22. The peripheral skirt 26 has an opening 27 which exposes the plug member and is constructed in a shape corresponding to the shape of the tubular enclosure 15 of the closure base 12. When assembled the opening 27 is flush with the shape of the tubular enclosure 15 allowing the lateral movement of the closure top 11 in relation with the closure base 12.

Figure 5:
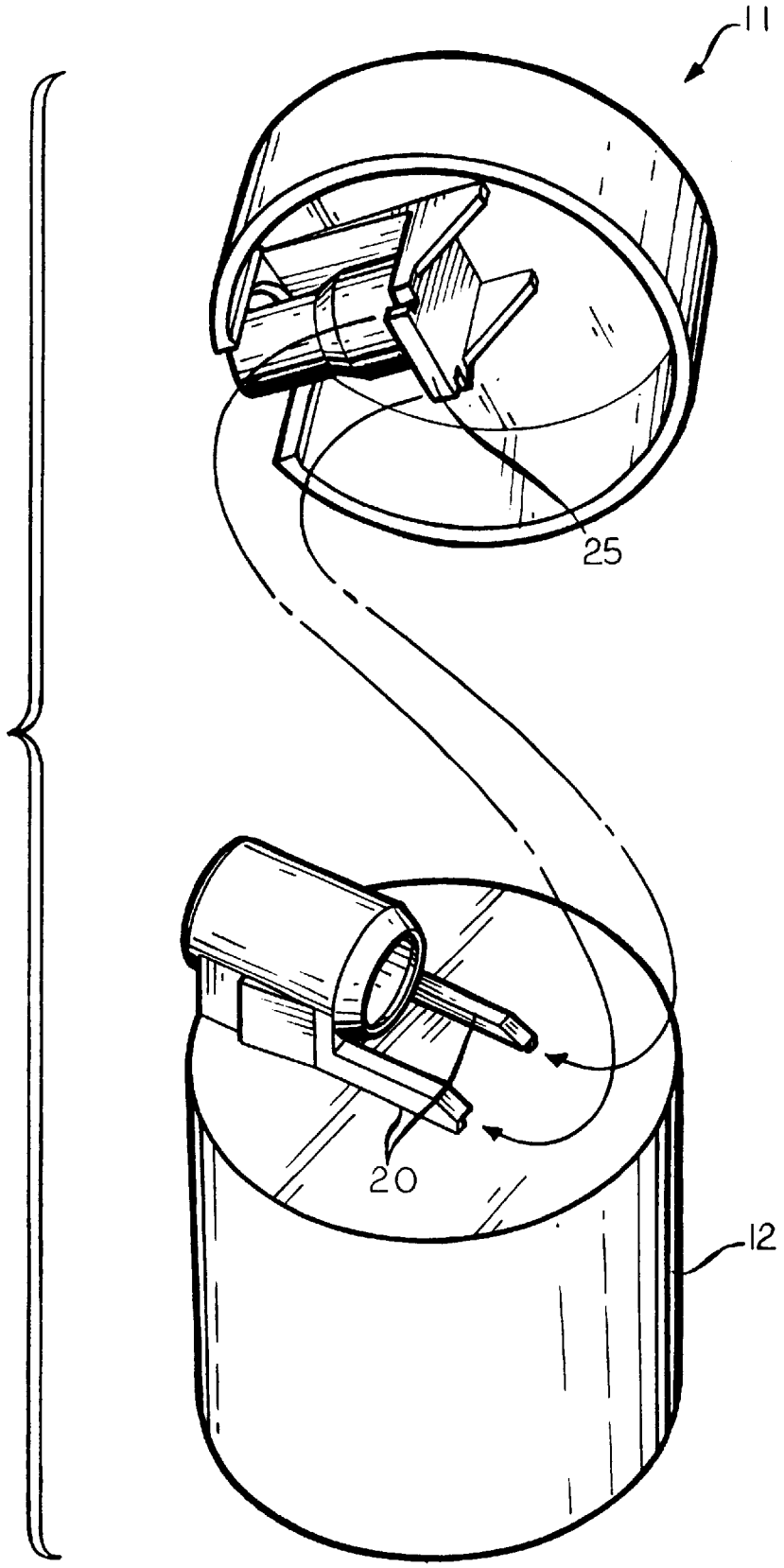
FIG. 5 is a perspective view of the closure top and closure base according to the present invention showing the attachment means.

FIG. 5 generally depicts the manner in which the attachment means 25 on the closure top 11 slidably interconnects with the rails 20 on the closure base 12 to enable the lateral movement of the closure top 11 in relation with the closure base 12.

Figure 6:
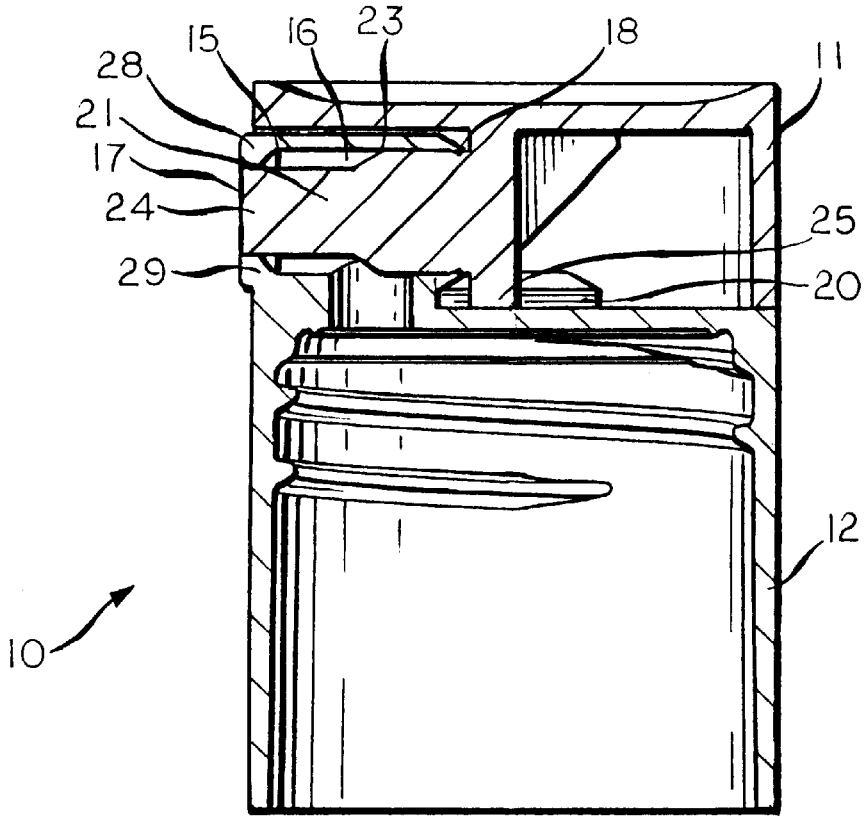
FIG. 6 is a fragmentary vertical, cross-sectional view of the assembled easy to use dispensing closure in a closed position.

FIG. 6 shows an assembled dispensing closure 10 in a closed position. The closure top 11 is assembled with the closure base 12 by inserting plug member 21 through the second opening 18 of the dispensing channel 16 formed by the hollow tubular enclosure 15. During insertion of the plug member 21 into the second opening 18, attachment means 25 of the closure top 11 is also aligned with rails 20 of the closure base 12. The rails 20 and corresponding attachment means 25 allow lateral movement of the plug member 21 on the top wall 11 in relation to the closure base 12 to move into and out of position of dispensing through opening 17. The hollow tubular enclosure 15 is tapered inwardly at the outer edge of the closure base 12 to form plug seal members as illustrated by numerals 28 and 29 so that the first opening 17 is fully sealed when the lesser diameter member 24 of the plug member 21 is positioned to the outer edge of the closure 10 at the first opening 17 against said plug seal members 28, 29.

Figure 7:
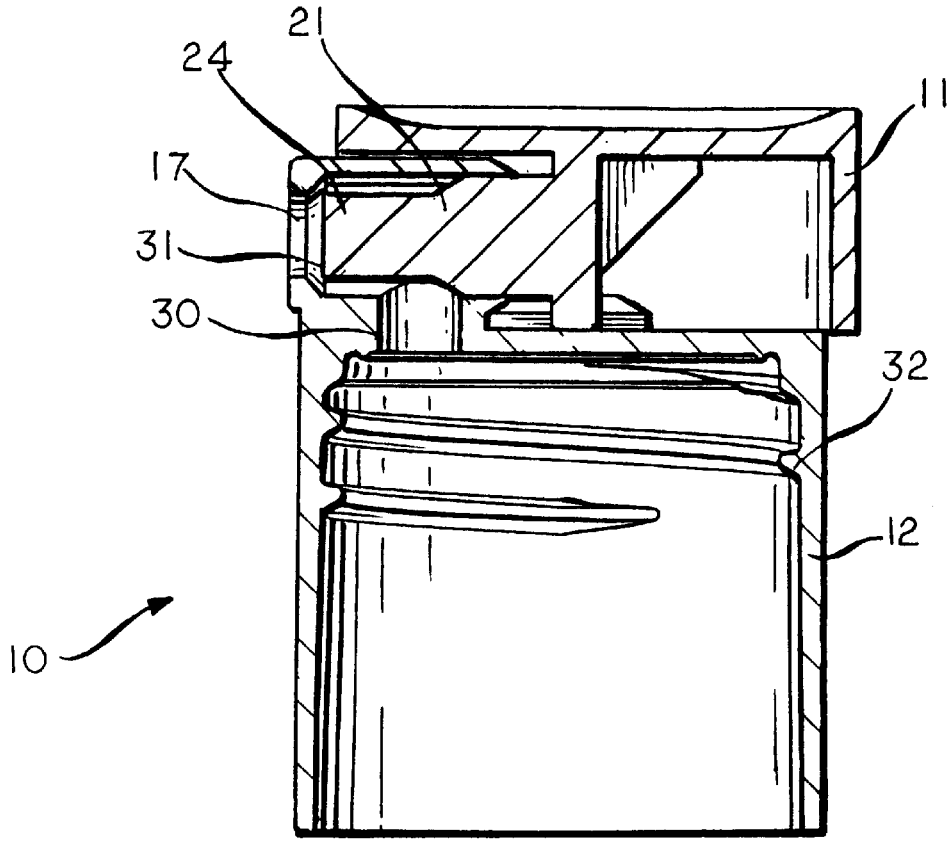
FIG. 7 is a fragmentary vertical, cross-sectional view of the assembled easy to use dispensing closure in an open dispensing position.

FIG. 7 shows an assembled dispensing closure 10 in an open position to allow dispensing of product from the container. In the open position the closure top 11 is laterally moved so that the lesser diameter member 24 of the plug member 21 is moved away from the first opening 17 allowing the product to dispense from the orifice 30 to the third opening 31 and out the first opening 17.

Once assembled, the two-piece dispensing closure 10 may be operated for dispensing by applying a force on the top wall 22 of the closure top 11 and sliding said closure top 11 laterally away from the first opening 17 in order to retract the lesser diameter member 24 of the plug 21 away from the plug seal members 28, 29 thereby allowing liquid to flow from the container to the orifice 30 to the third opening 31 and through the dispensing channel 16 of the first opening 17. Stops on each side of the hollow tubular enclosure 15 will allow the user to retract the lesser diameter member 24 of the plug 21 to a sufficient length to dispense liquid from the container while preventing disassembly of the closure top and closure bottom. After use, the dispensing closure 10 may be sealed by applying a force on the top wall 22 of the closure top 11 and sliding said closure top 11 laterally toward the first opening 17 to the point where the lesser diameter member 24 of plug 21 rests against the plug seal member 28, 29 to provide a seal to prevent further liquid being dispensed out of the first opening 17. The movement of the lesser diameter member 24 of the plug member 21 toward the first opening 17 also acts to clean the dispensing closure by causing any residual product to be forced out of the dispensing channel 16 providing a clean dispensing channel during storage of the container with the dispensing closure 10 between uses.

Although the invention has been illustrated and disclosed with reference to a specific embodiment, it is to be understood that modifications may be made to the invention without departing from the spirit of the invention or from the scope of the following claims.

What is claimed is:

1. A two-piece dispensing closure comprising:

(a) a closure base with a top wall and a peripheral skirt for attachment to a finish of a container, said closure base having an orifice on the top wall for communication with fluid in the container through an opening in the finish of the container;

(b) a hollow tubular enclosure defining a dispensing channel mounted above the orifice on the closure base, said tubular enclosure having at least three openings;

(c) said closure base further comprising an attachment means adapted to slidably interconnect a closure top;

(d) a closure top having a top wall and a peripheral skirt, said closure top having a plug member mounted below the top wall adapted for sliding engagement with the hollow tubular enclosure;

(e) said closure top further comprising an attachment means adapted to slidably interconnect the closure base; and (f) said closure base and closure top slidably interconnected for sliding in and out of engagement for dispensing.

2. The tubular enclosure of claim 1, wherein said at least three openings, comprise first opening at one end of the enclosure for dispensing fluid from the container, a second opening at the opposite end of the enclosure adapted to receive the plug member within the dispensing channel for opening and closing the first opening, and a third opening in communication with the orifice on the closure base for receiving fluid from the container.

3. The closure base of claim 1, wherein the peripheral skirt extends below the top wall of the closure base and further comprising threads on an inner surface for securing the closure base to the container finish.

4. The closure base of claim 1, wherein a orifice is located on an outer edge of the top wall of the closure base.

5. The closure base of claim 1, wherein the hollow tubular enclosure is mounted on an outer edge of the top wall of the closure base above the orifice providing communication between the orifice and a third opening of said at least three openings in the hollow tubular enclosure.

6. The closure base of claim 1, wherein a first opening of the at least three openings of the dispensing channel is located at the outer edge of the top wall and the second opening opposite the first opening is located toward a center of the top wall.

7. The closure base of claim 1, wherein the dispensing channel defined by the hollow tubular enclosure is symmetrically cylindrical and extends between the first and the second opening and is perpendicular to the third opening of said at least three openings and the orifice.

8. The closure base of claim 1, wherein the hollow tubular enclosure is tapered inwardly at an outer edge of closure base to form a seal.

9. The closure base of claim 1, wherein the hollow tubular enclosure further comprises stops to limit the relative movement of the closure top and prevent disassembly of the closure top.

10. The closure base of claim 1, wherein the attachment means comprises the hollow tubular enclosure having rails which slidably interconnect with said corresponding attachment means on the closure top.

11. The closure top of claim 1, wherein the plug member mounted below the top wall of the closure top comprises a cylindrical solid shaft extending from a center of the closure top to an outer edge of the closure top.

12. The closure top of claim 11, wherein the cylindrical solid shaft comprises a greater diameter toward the center of the closure top and a lesser diameter at the outer edge of the closure top.

13. The closure top of claim 1, wherein the attachment means is mounted below the plug member and comprises an inverted T-shaped notch which slidably interconnects with the on the closure attachment means base.

14. The closure top of claim 1, wherein the peripheral skirt extends below the top wall of the closure top and further comprises an opening corresponding to the shape of the tubular enclosure of the closure base wherein a first opening of the at least three openings of the tubular enclosure is exposed for dispensing.

15. A method of assembling a dispensing closure which may be secured to a container for dispensing liquid, said method comprising the step of:

providing a two-piece dispensing closure, said dispensing closure comprising a closure base with a top wall and a peripheral skirt for attachment to a finish of a container, said closure base having an orifice on a top wall for communication with fluid in the container through an opening in the finish of the container and a hollow tubular enclosure defining a dispensing channel mounted above the orifice on the closure base said tubular enclosure having at least three openings, a first opening at one end of the enclosure tor dispensing fluid from the container, a second opening at the opposite end of the enclosure adapted to receive a plug member within the dispensing channel for opening and closing the first opening, and a third opening in communication with the orifice on the closure base for receiving fluid from the container and an attachment means adapted to slidably interconnect a closure top; and a closure top having a top wall and a peripheral skirt, said closure top having a plug member mounted below the top wall adapted for sliding engagement with the hollow tubular enclosures and an attachment means adapted to slidably interconnect the closure base;

inserting plug member of closure top into the second opening of plug dispensing channel of the closure base;

aligning the attachment means of the closure top with the attachment means of the closure base so that plug member of the closure top is laterally movable in relation to the dispensing channel of the closure base to move into and out of position of dispensing through first opening of the closure base.

16. The method of claim 14, further comprising the step of providing said container with product secured to said dispensing closure.

* * * * *